US006039616A

United States Patent [19]

Pereira et al.

[11] Patent Number: 6,039,616

[45] Date of Patent: Mar. 21, 2000

[54] CIRCULAR ELECTRICAL CONNECTOR

[75] Inventors: John Pereira, Rehoboth, Mass.; Manuel Machado, Hope; Stephen Antaya, West Kingston, both of R.I.

[73] Assignee: Antaya Technologies Corporation, Cranston, R.I.

[21] Appl. No.: 09/199,810

[22] Filed: Nov. 25, 1998

[51] Int. Cl.[7] ..... H01R 4/10

[52] U.S. Cl. ..... 439/874; 439/83

[58] Field of Search ..... 439/874, 876, 439/83, 78

[56] References Cited

U.S. PATENT DOCUMENTS

| | | | |
|---|---|---|---|
| 1,014,718 | 1/1912 | Parsons . | |
| 3,034,202 | 5/1962 | Graves, Jr. | 29/155.55 |
| 3,085,577 | 4/1963 | Berman et al. | 128/418 |
| 3,103,067 | 9/1963 | Dixon | 29/473.1 |
| 3,155,808 | 11/1964 | Wiley | 206/172 |
| 3,337,947 | 8/1967 | Terrill et al. | 29/475 |
| 3,621,442 | 11/1971 | Racht et al. | 338/309 |
| 4,409,278 | 10/1983 | Jochym | 428/163 |
| 4,490,005 | 12/1984 | Hovey | 339/278 C |
| 4,591,401 | 5/1986 | Neidig et al. | 156/89 |
| 4,645,288 | 2/1987 | Stursa | 439/876 |
| 4,782,197 | 11/1988 | Stunzi et al. | 174/152 R |
| 4,785,988 | 11/1988 | Topel et al. | 228/122 |
| 5,208,444 | 5/1993 | Winter et al. | 219/547 |
| 5,232,383 | 8/1993 | Barnick | 439/859 |
| 5,260,549 | 11/1993 | Garritano | 219/541 |
| 5,309,634 | 5/1994 | Van Order et al. | 29/863 |
| 5,312,269 | 5/1994 | Hwang | 439/500 |
| 5,543,601 | 8/1996 | Bartrug et al. | 219/203 |
| 5,644,830 | 7/1997 | Ladouceur et al. | 29/432.2 |
| 5,735,446 | 4/1998 | White et al. | 228/114.5 |

*Primary Examiner*—Gary F. Paumen

*Attorney, Agent, or Firm*—Hamilton, Brook, Smith & Reynolds, P.C.

[57] ABSTRACT

At electrical connector includes a cylindrical post and a base which carried a layer of solder. The bottom surface of the base is provided with standoffs which extend from the base to space the connector from a surface to which the connector is soldered, to ensure that a minimum volume of solder stays between the connector and the mating surface.

13 Claims, 1 Drawing Sheet

CIRCULAR ELECTRICAL CONNECTOR

BACKGROUND OF THE INVENTION

1. Field of the Invention

The present inventions relates to electrical connectors, and more particularly to electrical connectors which are attached to flat surfaces with solder.

2. Brief Description of the Related Art

A variety of electrical connectors have been proposed in the past for numerous specific purposes. For example, electrical connectors have been proposed for use in glass, e.g., vehicle windscreens, for allowing electrical connection between electrical devices embedded in the glass and sources of power and/or other electrical devices. Windscreens often are equipped with electric heaters or defrosters which are embedded between layers which make up the windscreen, and include a simple flat electrical contact for establishing an electrical connection with the defroster. Such flat connections are typically formed by screening a conductive coating, e.g., silver, onto an exterior portion of the windscreen in which a lead from the defroster protrudes. Thus, in order to make electrical contact with the defroster, an electrical connector must be mounted onto the glass so that the connector establishes electrical communication with the flat conductive coating.

One electrical connector which has been proposed for mounting on a conductive coating of a windscreen includes an upstanding cylindrical post and a flat base which carries a layer of solder thereon. Such an electrical connector was first made available by Antaya, Inc., Cranston, R.I. The layer of solder is pressed against the contact on the windscreen, and the solder is heated to flow the solder. Pressure is simultaneously applied to the connector, which presses against the windscreen's contact. While this device has in the past proven to be useful and has advantages in certain applications, because this prior connector has a flat surface which is soldered against the flat surface of a windscreen's contact, the pressure applied when soldering tends to press or squeeze much of the solder out from under the connector. Thus, the prior connector is oftentimes mismounted to the windscreen, because most of the solder has been squeezed out from between the connector and the windscreen's contact during the soldering process. This results in connectors which cannot meet vehicle manufacturing standards for the strength of the connections between windscreens and their electrical connectors. Such mismounting of the prior electrical connectors results in a considerable amount of rework, scrap, and increases in labor time and costs to correct mismounted connectors.

A further difficulty encountered with prior electrical connectors is that they are typically very small. The size of some standard electrical connectors, including many battery connectors, makes the manufacturing processes for forming large quantities of these small connectors extremely difficult to automate. Close tolerances are also difficult to maintain during the manufacturing process, and even small changes to such a connector can necessitate complete retooling after considerable expenditures in reengineering.

SUMMARY OF THE INVENTION

In a first exemplary embodiment in accordance with the present invention, an electrical connector useful for making electrical contact with a glass surface comprises a post member having first and second ends, said post member including a cylindrical portion having a closed top at said first end a foot portion at said second end, and a base member mounted to said foot portion, said base member having a bottom surface facing away from said post member, said bottom surface including at least one standoff extending from said bottom surface, whereby when said base member bottom surface is rested against a contact surface to which said electrical connector is to be soldered, said at least one standoff defines a minimum volume between said bottom surface and said contact surface which, when filled with solder, is sufficient to hold said electrical connector to said contact surface.

Still other objects, features, and attendant advantages of the present invention will become apparent to those skilled in the art from a reading of the following detailed description of embodiments constructed in accordance therewith, taken in conjunction with the accompanying drawings.

BRIEF DESCRIPTION OF THE DRAWINGS

The invention of the present application will now be described in more detail with reference to preferred embodiments of the apparatus and method, given only by way of example, and with reference to the accompanying drawings, in which.

DESCRIPTION OF THE PREFERRED EMBODIMENTS

Figure 1:
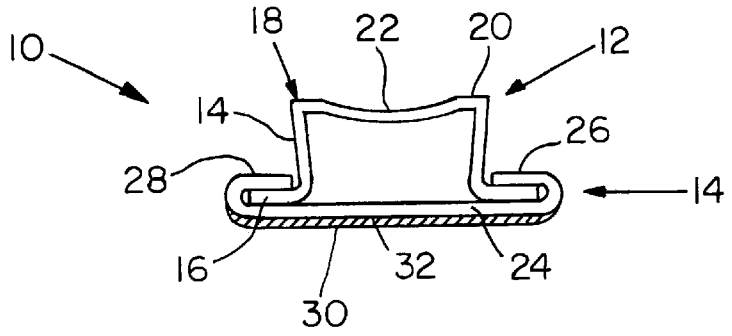
FIG. 1 is a side elevational view of a first embodiment of an electrical connector.

Referring to the drawing figures, like reference numerals designate identical or corresponding elements throughout the several figures.

FIG. 1 illustrates an exemplary embodiment of an electrical connector. Electrical connector 10 includes a post member 12 and a base member 14, which are connected together to form the connector. Post member 12 includes a generally cylindrical portion 14 and a foot portion 16 which extends away from the cylindrical portion. Cylindrical portion 14 extends upward from foot portion 16, and preferably angles radially outward between the foot portion and a top 18. Top 18 includes a flat peripheral portion 20 adjacent the outer edge of the top, and a concave, cupped inner portion 20. Foot portion 16 can be continuous and shaped as a disk (see FIG. 3), or alternatively can be formed of a plurality of individual tabs which extend away from cylindrical portion 14 and which are separated by spaces (not illustrated).

Base member 14 is generally circular and includes a bottom portion 24 and at least two tabs 26, 28 which wrap around foot portion 16 of post member 12. A layer of solder 30 is provided on the lower surface 32 of bottom portion 24, so that electrical connector 10 can be soldered to a mating surface, as described in greater detail below.

Figure 2:
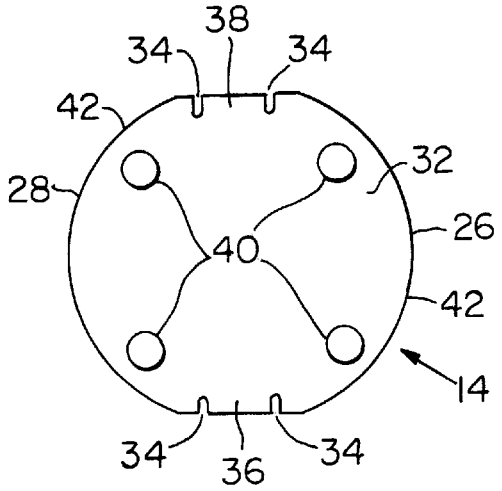
FIG. 2 is a bottom plan view of the electrical connector illustrated in FIG. 1.

Referring to FIG. 2, base member 14 is illustrated without solder layer 30. It is to be understood, however, that preferable embodiments of electrical connector 10 include solder layer 30. Less preferable embodiments do not include solder layer 30, and are still within the spirit and scope of the invention. FIG. 2 illustrates base member 14 having tabs 26, 28, which extend into the plane of the illustration. At least two notches 34 are formed in base member 14 at the ends of tabs 26, 28, and are preferably formed with curved ends so that they act to relieve stress concentrations at the ends of the tabs. In the embodiment illustrated in FIG. 2, four notches are provided. Extensions 36, 38 extend from base member 14 between pairs of notches 32. Extensions 36, 38 can be eliminated from base member 14, thereby leaving essentially two wider notches on base member 14.

Lower surface 32 includes at least one, preferably at least three, and more preferably four standoffs or posts 40. Standoffs 40 extend downwardly away from lower surface 32, up and out of the plane of the illustration of FIG. 2. Standoffs 40 are preferably cylindrical, can be either hollow or solid, and are preferably positioned adjacent an outer edge 42 of base member 14. Less preferably, standoffs 40 can be located close to each other and near the center of lower surface 32.

Figure 3:
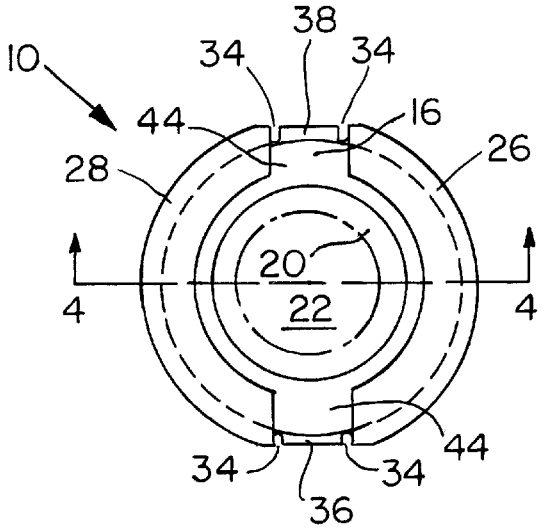
FIG. 3 is a top plan view of the electrical connector illustrated in FIG. 1.

Turning now to FIG. 3, a top plan view of connector 10 is illustrated. Two tabs 26, 28 are illustrated in FIG. 3. According to yet another embodiment of electrical connector 10, three or more tabs can be provided on base member 14 which extend around foot portion 16 and which are spaced apart circumferentially. By way of example and not by limitation, three tabs can be provided on base member 14 which wrap around foot portion 16. When three tabs are provided, there will be three gaps 44 (two of which are illustrated in FIG. 3) between the three tabs, and preferably three sets of notches 34. As will be readily apparent to one of ordinary skill in the art, more than three tabs can be provided on base member 14 and still be within the spirit and scope of the invention.

Tabs 26, 28 are generally crescent or "C" shaped, and are separated by gaps 44. Tabs 26, 28 extend radially inward toward cylindrical portion 14 of post member 12. Tabs 26, 28 can extend to cylindrical portion 14. When more than two tabs are provided, the tabs have a smaller circumferential length than tabs 26, 28, as will be readily appreciated by one of ordinary skill in the art.

Figure 4:
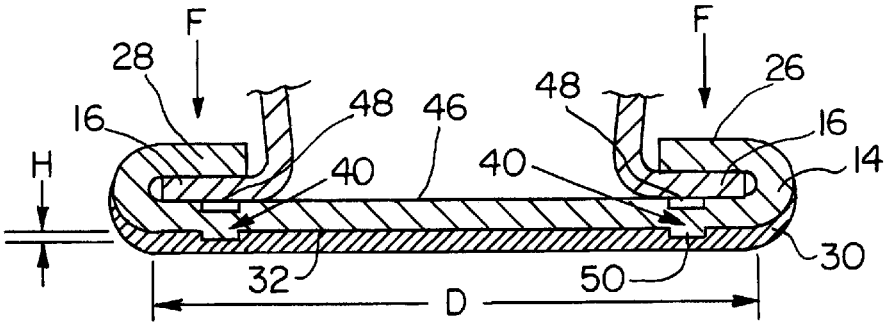
FIG. 4 is a partial cross-sectional view of the electrical connector illustrated in FIG. 1, take at line 4—4 in FIG. 3.

FIG. 4 illustrates a cross-sectional view of connector 10, with the upper portions of post member 12 broken away, taken at line 4—4 in FIG. 3. Base member 14 has a top surface 46, which includes dimples or recesses 48. Recesses 48 are formed in top surface 46 when standoffs 40 are formed by stamping base member 14 to deform the base member to create the standoffs, and therefore recesses 48 are artifacts of the stamping process. Recesses 48 perform an additional function in base member 14 by acting as a stress concentrator in the base member. Recesses 48 can therefore assist in assuring that tabs 26, 28 wrap around foot portion 16 without causing buckling or binding of base member 14 when the tabs are wrapped around the foot portion. When standoffs 40 are formed by a process which does not involve deforming base member 14, recesses 48 can be eliminated, such as forming the standoffs with a small rivot or the like.

Standoffs 40 each have substantially the same height H, measured from their bottom surfaces 50 to lower surface 32, and base member 14 has a diameter D defined as the largest linear distance across the lower surface. Because tabs 26, 28 curve up from base member 14, diameter D is slightly smaller than the distance between the edges of tabs 26, 28 described above with reference to FIG. 2. Height H and diameter D therefore together define a minimum volume V below lower surface 32, the value of which is computed from the formula:

$$V=(\pi/4)\cdot H\cdot D^2$$

Thus, for a particular diameter D, and therefore size of connector 10, the height H of standoffs 40 determines the volume V.

Volume V is filled with solder 30, which preferably covers standoffs 40 so that there is solder in excess of that necessary to fill volume V. Height H, and therefore volume V of solder 30, is selected so that electrical connector 10 will bond to a mating surface with a preselected strength, which is a function of the volume V of solder which connects the electrical connector to the mating surface. Standoffs 40 ensure that no less than volume V of solder 30 is available for joining connector 10 with a mating surface to which the connector is soldered.

A process of using electrical connector 10 will now be described with reference to FIGS. 1–4. Electrical connector 10, preferably with a layer of solder 30 covering standoffs 40, is placed on a mating surface (not illustrated) so that the solder layer rests flat against the mating surface. According to one preferred embodiment of the present invention, the mating surface is a glass surface, e.g., a piece of automobile glass in which an electrical device is embedded, and the glass surface includes an electrically conductive coating, e.g. a silver coating, to form an electrical connection with connector 10. With connector 10 resting on the mating surface, a soldering device (not illustrated) is pressed against the connector, e.g., against post portion 12, tabs 26, 28, or both, with a force F. Because foot portion 16 extends under tabs 26, 28 and is connected to post portion 12, force F is transmitted through connector 10 in the region above standoffs 40, and through the solder layer. As will be readily appreciated by one of ordinary skill in the art, the soldering device also heats solder layer 30 to a temperature at which it becomes liquefied. The combined effect of force F and the liquid state of heated solder layer 30 is to bond the liquified solder to the mating surface and lower surface 32 of base member 14, including standoffs 40. Standoffs 40, however, prevent force F from pressing lower surface 32 against the mating surface, and therefore leaves at least volume V of liquified solder 30 to hold connector 10 to the mating surface.

Standoffs 40 also function to maintain base member 14 in a generally planar shape while force F presses connector 10 against the mating surface. By locating standoffs 40 in the area under foot portion 16 and tabs 26, 28, which is the same area through which force F is transmitted through connector 10, the standoffs transmit all of force F (albeit at a higher pressure) once lower surface 50 has been exposed by liquified solder 32 having flowed away from the standoffs. By requiring all of force F to be transmitted through tabs 26, 28, foot portion 16, and standoffs 40 at this stage of the soldering process, the portion of base member 14 between the standoffs bears little or no load, and therefore base member 14 will not be bent by force F. Thus, standoffs 40 maintain the planar shape of base member 14 during soldering, which further ensures that connector 10 will be uniformly soldered to the mating surface.

In accordance with a preferred embodiment of connector 10, the diameter of top 18 is about 5.72 mm; the distance between edges 26, 28 is about 8.90 mm; the distance between the lower surface of solder layer 32 and the upper surface of tabs 26, 28 is about 1.35 mm; the distance between the upper surface of tabs 26, 28 and top 18 is about 3 mm; the distance from the center of base member 14 to the center of each standoff is about 3.4 mm; each height H is between about 0.05 mm and about 0.15 mm, preferably about 0.1 mm; post member 12 is formed of 70/30 brass of about 0.016 inch thickness; base member 14 is formed of 70/30 brass of about 0.012 inch thickness; solder layer 30 is about 0.013 inch thick and formed of 25% Sn, 62% Pb, 10% Bi, and 3% Ag, and solder layer 30 includes a flux coating.

Furthermore, post portion 12 conforms to the International Electro Technical Commission ISO standard for battery connectors type 17, miniature non-resilient snap-fastener connectors, and the combination of the height H of standoffs 40, the particular solder chosen, and the effective diameter D of the base member results in electrical connector 10, when soldered onto a silver-coated windscreen, having a pull-strength of at least about 80 pounds.

While the invention has been described in detail with reference to preferred embodiments thereof, it will be apparent to one skilled in the art that various changes can be made, and equivalents employed, without departing from the scope of the invention.

What is claimed is:

1. An electrical connector useful for making electrical contact with a coated glass surface, comprising:

an electrically conductive post member having first and second ends, said post member including a cylindrical portion having a top at said first end and a foot portion at said second end; and an electrically conductive base member mounted to said foot portion, said base member having a top surface and a bottom surface facing away from said post member, said bottom surface including at least one standoff extending from said bottom surface, said foot portion being mounted directly on said top surface;

whereby when said base member bottom surface is rested against a contact surface to which said electrical connector is to be soldered, said at least one standoff raises said bottom surface to defines a minimum volume between said bottom surface and said contact surface which, when filled with solder, is sufficient to hold said electrical connector to said contact surface.

2. An electrical connector in accordance with claim 1, wherein said foot portion extends outwardly from said cylindrical member.

3. An electrical connector in accordance with claim 1, wherein said at least one standoff comprises at least three standoffs arranged on said bottom surface.

4. An electrical connector in accordance with claim 3, wherein said at least one standoff comprises four standoffs arranged on said bottom surface.

5. An electrical connector in accordance with claim 1, wherein said post member cylindrical portion is wider adjacent said first end than adjacent said second end.

6. An electrical connector in accordance with claim 1, wherein said base member further comprises at least two tabs which are wrapped over said foot portion and hold said base member and said post member together.

7. An electrical connector in accordance with claim 6, wherein said at least two tabs and said foot portion overlap at an overlap region where said at least two tabs are wrapped over said foot portion, said at least one standoff being positioned on said bottom surface under said overlap region.

8. An electrical connector in accordance with claim 6, wherein said base member further comprises:

a top surface opposite said base member bottom surface; and at least one recess into said base member top surface.

9. An electrical connector in accordance with claim 8, wherein said at least one recess is located on said base member top surface opposite said at least one standoff.

10. An electrical connector in accordance with claim 1, wherein said top comprises a closed top having a flat outer peripheral portion and a concave inner portion.

11. An electrical connector in accordance with claim 1, wherein said post member is hollow.

12. An electrical connector in accordance with claim 1, further comprising a solder layer on said base member bottom surface.

13. An electrical connector in accordance with claim 12, wherein said solder layer has a thickness greater than a height of said at least one standoff.

* * * * *